United States Patent [19]

Reuther

[11] 4,028,532

[45] June 7, 1977

[54] TURBINE SPEED CONTROLLING VALVE OPERATION

[75] Inventor: John F. Reuther, Pittsburgh, Pa.

[73] Assignee: Westinghouse Electric Corporation, Pittsburgh, Pa.

[22] Filed: Nov. 2, 1973

[21] Appl. No.: 412,513

Related U.S. Application Data

[63] Continuation of Ser. No. 247,888, April 26, 1972, abandoned.

[52] U.S. Cl. ..... 235/151.1; 235/151.21; 444/1

[51] Int. Cl.[2] ..... F01D 19/00

[58] Field of Search ..... 235/151.1, 151.21, 151, 235/151.3, 92 GE, 92 CP, 92 TF, 92 CT; 415/13, 14, 15, 16, 17, 30; 60/73, 105; 340/172.5; 444/1

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |
| 3,686,484 | 8/1972 | Ciemochowski | 235/92 CA X |

OTHER PUBLICATIONS

Computer and Apparatus for Measuring Rotational Speed; S. Bederman; IBM Technical Disclosure Bulletin; vol. 13 No. 4, Sept. 1970, pp. 1017–1018.

Application of the PRODAC 50 System to Direct Digital Control, J. C. Belz, G. J. Kirk & P. S. Radcliffe, IEEE Intl. Conv. Rec. Part 3, 1965, pp. 102–122.

Monitoring and Automatic Control in Steam Power Stations by Process Computer, E. Doetsch & G. Hirschberg, Siemens Review XXXV(1968), No. 12, pp. 471–476.

*Primary Examiner*—Edward J. Wise

*Attorney, Agent, or Firm*—E. F. Possessky

[57] ABSTRACT

Improved turbine speed controlling valve operation is provided through the accumulation for direct entry into a digital computer of a count of displacement pulses generated by incremental rotation of the turbine output shaft. The digital computer is operative to position the control valves in response to the speed of rotation of the output shaft calculated either as a function of the number of pulses accumulated in a predetermined interval or the time required to accumulate a preselected count, depending upon the operating point of the turbine. The accumulation of displacement pulses can be inhibited while the time measurement is being read to avoid errors in measurement.Resumption of the accumulation of displacement pulses and the measurement of time is synchronized to preserve accuracy.

27 Claims, 10 Drawing Figures

TURBINE SPEED CONTROLLING VALVE OPERATION

This is a continuation of application Ser. No. 247,888, filed Apr. 26, 1972, now abandoned.

CROSS-REFERENCE TO RELATED APPLICATIONS

Reference is made to the following co-pending applications which are assigned to the same assignee as this application:

(1) U.S. Pat. application Ser. No. 246,900 entitled "SYSTEM AND METHOD FOR STARTING,SYNCHRONIZING AND OPERATING A STEAM TURBINE WITH DIGITAL COMPUTER CONTROL" filed by Robert Uram and Theodore C. Giras on Apr. 24, 1972; and (2) a continuation-in-part application bearing Ser. No. 247,440 filed on Apr. 25, 1972; and (3) a second continuation-in-part application bearing Ser. No. 247,877 filed on Apr. 26, 1972.

FIELD OF THE INVENTION

This invention relates to elastic fluid turbines and more particularly to systems and methods for controlling such turbines through the use of a programmed digital computer.

STATE OF THE PRIOR ART

In all of the prior art systems for controlling turbines, the rotational speed of the turbine shaft is considered in a control loop either as an end-controlled or intermediate-controlled system variable. In an early control system for electric power generating steam turbines, the rotational speed of the turbine was determined by a hydraulic pump driven by the output shaft of the turbine. The discharge pressure of the pump was proportional to the speed of rotation of the shaft. This speed signal was used in a hydromechanical system which positioned the steam valves to control the output of the turbine.

Other analog systems for determining turbine speed have been developed over the years. In one prior art analog control system described in (4) U.S. Pat. No. 3,098,176, ELECTRIC LONG RANGE SPEED GOVERNOR, by M. A. Eggenberger, P. H. Troutman, and J. F. Sauter, a tachometer generator connected to the turbine shaft generates a DC signal having a magnitude which is proportional to the actual speed of the turbine. This signal is then utilized in a servo loop to position the control valves. In another prior art system described in (5) U.S. Pat. No. 3,097,488, TURBINE CONTROL SYSTEM, by M. A. Eggenberger, P. H. Troutman and P. C. Callan, a permanet magnetic generator attached to the turbine shaft generates an AC signal having a frequency proportional to actual turbine speed. This AC signal is converted to a DC signal by saturating magnetic cores to provide a feedback voltage signal proportional to the frequency of the AC signal and therefore the speed of the turbine.

According to one of the more recently developed turbine control systems, pulses generated by a reluctance pickup activated by a toothed wheel connected to the turbine shaft, are translated into a DC Voltage which is utilized in an analog control circuit. A typical circuit for accomplishing the desired translation from a pulse frequency to a DC voltage is shown in (6) U.S. Pat. No. 3,090,929, CONTROLLER CIRCUITRY WITH PULSE WIDTH MODULATOR by F. T. Thompson, assigned to the same assignee as this application. This technique has been employed in digital-analog feedback controls such as that set forth in (7) U.S. Pat. No. 3,452,258, entitled DIGITAL ANALOG FEEDBACK CONTROL SYSTEM EMPLOYING SOLID STATE DIGITAL POTENTIOMETER, by F. T. Thompson, also assigned to the same assignee as this application.

The frequency to voltage conversion technique provided by the last mentioned prior art system has operated satisfactorily in an electro-hydraulic control system such as is described in (8) an article by M. Birnbaum and E. G. Noyes, presented to the ASME-IEEE NATIONAL POWER CONFERENCE in Albany, New York, Sept. 19–23, 1965. In applying the frequency to voltage conversion technique to this type of system, the speed voltage is applied directly to a control network of the general type described in the Thompson U.S. Pat. No. 3,452,258 (Ref. 7).

The digital-electrohydraulic turbine control systems described in great detail in the co-pending applications (Refs. 2 and 3) mentioned above, and the commonly owned application (9), entitled "IMPROVED SYSTEM AND METHOD FOR OPERATING A STEAM TURBINE AND AN ELECTRIC POWER GENERATING PLANT" by T. C. Giras and M. E. Birnbaum, Ser. No. 722,779, filed Apr. 19, 1968, in which the basic control algorithms are solved within a programmed digital computer, have rendered the frequency to voltage conversion technique, described above, impractical. This is a consequence of the fact that the central processing unit of a digital computer operates only in response to digital input signals and the fact that it is continuously performing digital routines under the control of programmed instructions. The instructons are carried out one at a time in serial form, albeit at an extremely rapid rate. However, since the computer can perform only one operation at a time, externally generated data can only be accepted by the computer by interrupting the routine in process or by waiting until the routine which is running has been completed. Determinations of this nature are made by the executive program which establishes priorities for the various routines including the input routines.

In real time control, various system status signals are generated independently of th computer cycle time. System conditions which can be expressed in terms of yes or no, or on or off, can be monitored by switches or relays which by their very nature generate signals in binary form. The status of the variable being monitored is "stored" by the condition of the switch or relay until the central processing unit of the computer is ready to accept it. Such inputs are known as contact inputs. Numerous schemes for multiplexing and paralleling contact inputs have been developed to improve the efficiency of the computer system.

Not all system conditions can be expressed in terms of yes or no, or on or off. Some conditions must be reported to the central processing unit of the computer as a continuous function of the system variable being monitored. Such analog functions must be transformed into digital signals before they can be accepted by the computer. Many types of analog to digital (A-D) converters have been developed to perform this transformation. One type of A-D converter described in (10) U.S. Pat. No. 3,530,458, entitled ANALOG TO DIGITAL CONVERSION SYSTEM HAVING IMPROVED ACCURACY BY F. G. Williard, F. T. Thompson and C. A. Booker, Jr. and assigned to the same assignee as this invention, converts the DC voltage into pulses having a frequency which is a function of the analog voltage level in a voltage to frequency converter. The pulses so generated are integrated in a digital counter and the resultant signal is fed into the central processing unit of the computer. Such conversion takes time and where frequent sampling of the variable being monitored is central to proper dynamic control of the system, an A-D converter may be engaged for a considerable period of its operating time merely monitoring a single analog signal. However, economic considerations dictate the number of A-D converters that can be provided in the system. In this respect, a reading of U.S. Pat. No. 3,530,458, (Ref. 10), will make it evident that the sophisticated circuitry required to insure the accuracy and stability of A-D converters greatly adds to their cost. Under such circumstances, it is desirable to devise other less expensive, more accurate and more reliable specialized equipment to prepare signals for input into the digital computer.

SUMMARY OF THE INVENTION

According to the invention, control of a turbine through manipulation of valves regulating the flow of motive fluid to the turbine is effected by operating a programmed digital computer to regulate the positioning of the valves in accordance with selected criteria including the speed of rotation of the output shaft of the turbine. The speed of rotation of the output shaft is determined by operating the digital computer to calculate the speed as a function of the rate of accumulation of displacement pulses generated by incremental rotation of the shaft. Preferably, the speed is determined either as a function of the time interval required to accumulate a preselected count of displacement pulses or the number of displacement pulses accumulated in a predetermined interval. Preferably the data necessary for both calculations is generated continually with the computer selecting the best solution depending upon the operating point of the turbine.

The displacement pulses are accumulated in digital counting means located externally of the computer. The accumulated count may be read directly into the computer at the end of each predetermined interval. An oscillator and second digital counting means may also be provided externally of the computer to measure the time interval over which the counts are accumulated. Means are provided for inputting the accumulated count of timing pulses into the computer when the accumulated count of displacement pulses reaches the preselected count.

In the interest of improving the resolution of the speed determination, the frequency of the oscillator is several times the frequency at which displacement pulses are generated in the normal operating range of the turbine. In order to avoid losing timing pulses during the interval required for inputting the timing count into the computer, both counters are momentarily inhibited when the displacement count becomes equal to the preselected count. Resumption of counting by both counting means once the transfer is completed is synchronized with the occurance of the displacement pulses to assure accuracy.

The predetermined count of timing pulses and the preselected count of displacement pulses may be determined by the digital computer.

DESCRIPTION OF THE PREFERRED EMBODIMENT

Figure 1:
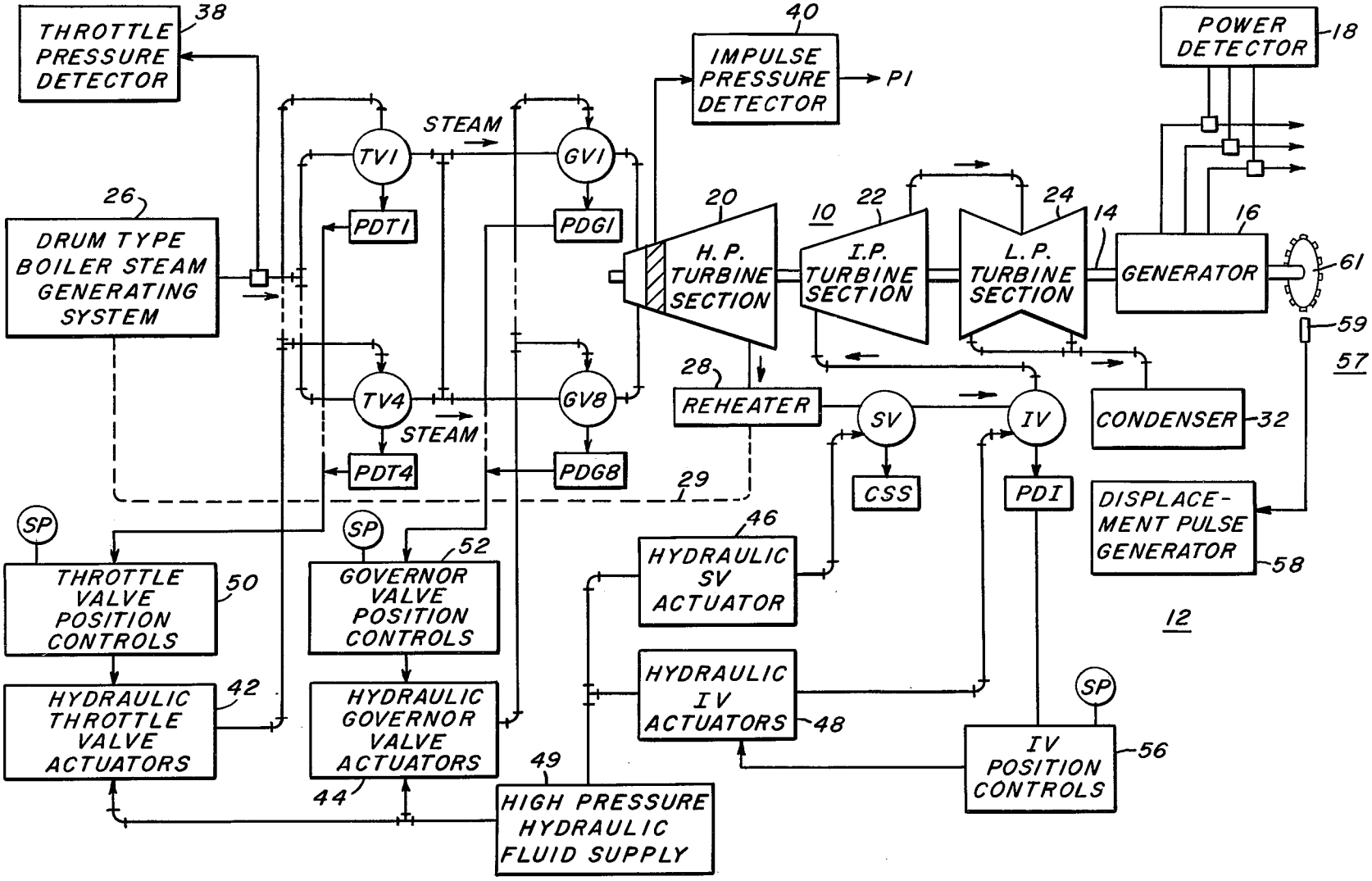
FIG. 1 is a schematic diagram of an electric power plant which incorporates a steam turbine system embodying the invention.

Although the invention is suitable for use with other types of turbines, it will be described as applied to a steam turbine which serves as the prime mover in the electric power generation system described in the copending applications Refs. 1, 2 and 3 and illustrated in FIG. 1. The turbine identified by the general reference character 10 is provided with an output shaft 14 which drives a conventional large alternating current generator 16 to produce three-phase electric power as measured by conventional power detector 18. The generator 16 is connected to a large electric power network and once so connected causes the turbo-generator arrangement to operate at synchronous speed under steady state conditions. Under transient electric load conditions, system frequency may be affected resulting in turbo-generator speed changes. At synchronism, power contribution of the generator 16 to the network is normally determined by the turbine steam flow which in this instance is supplied to the turbine 10 at substantially constant throttle pressure.

The turbine 10 is of the multi-stage axial flow type and includes a high pressure section 20, an intermediate pressure section 22, and a low pressure section 24. The constant throttle pressure steam for driving the turbine 10 is developed by a steam generating system 26 which is provided in the form of a conventional drum-type boiler operated by fossil fuel. Steam flow is directed to the turbine steam chest (not specifically indicated) through four throttle inlet valves TV1–TV4. From the steam chest the steam is directed to the first high pressure section expansion stage through eight governor inlet valves GV1–GV8.

After the steam has coursed through the high pressure section of the turbine, it is directed to a reheater system 28 which is connected with the boiler 26 in heat-transfer relation as indicated by the reference character 29. The reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

To control the flow of reheat steam, stop valving SV including one or more check valves is normally open and is closed only to prevent steam backflow or to protect against turbine overspeed. Intercept valving IV including a plurality of valves (only one indicated) is also provided in the reheat steam flow path. It is normally open but operates over a range of positioning control to provide reheat steam flow cutback modulation under turbine overspeed conditions.

Separate hydraulically operated throttle valve actuators, collectively indicated by the reference character 42, are provided for the four throttle valves TV1–TV4. Similarly, separate hydraulically operated governor valve actuators, collectively indicated by the reference character 44, are provided for the eight governor GV1–GV8. Hydraulically operated actuators indicated by the reference characters 46 and 48 are also provided for the reheat stop and intercept valving SV and IV. A computer sequenced and monitored high pressure fluid supply 49 provides the controlling fluid for actuator operation of the valves TV1–TV4, GV1–GV8, SV and and IV.

The actuators 42, 44, 46 and 48 are of conventional construction. The inlet valve actuators 42 and 44 and the intercept valve actuators 48 are operated by stabilizing position controls indicated collectively by the reference characters 50, 52 and 56 respectively. The position controls each include a conventional analog controller, (not indicated), which drives a suitable known actuator servo valve (not indicated) in a well known manner. The reheat stop valve actuators 46 are manually or computer controlled to be fully open unless conventional trip system operation or other operating means causes them to close and stop the reheat steam flow.

Since turbine power is proportional to steam flow under the assumed control condition of substantially constant steam throttle pressure, steam valving position is controlled to produce control over steam flow as an intermediate variable and over turbine speed and/or load as an end controlled variable(s). Actuator operation provides the steam valve positioning, and respective valve position detectors PDT1–PDT4, PDG1–PDG8, and PDI are provided to generate respective valve position feedbak signals for developing position error signals to be applied to the respective position controls 50, 52 and 56. One or more contact sensors CSS provides status data for the stop valving SV.

The combined position control, hyraulic actuator, valve position detector element and other miscellaneous devices (not shown) form a local hydraulic-electrical analog valve position control loop for each throttle or governor inlet steam valve. The position set points SP are computer determined and supply to the respective local loops an updated position on a periodic basis. Set points SP are also computed for the intercept valve control.

A speed sensing system 57 is provided to determine the turbine shaft speed for speed control and for frequency participation control purposes. The speed detecting system 57 includes a reluctance pick-up 59 magnetically coupled to a tooth wheel 61 connected to the turbo-generator shaft 14. The AC signal generated by the reluctance pick-up 59 as the toothed wheel 61 rotates with the turbo-generator activates displacement pulse generator 58 to generate shaped pulses DP as both the leading and trailing edge of each tooth on the toothed wheel 61 pass the reluctant pick-up 59. Such systems which generate pulses at a frequency proportional to the speed of a rotating shaft are well known. The pulses generated by the displacement pulse generator 58 are digitally transformed into signals directly usable by the computer in digital input equipment to be described in detail below.

The signals produced by the speed detector system 57, the power detector 18, and pressure detectors 38 and 40, the valve position detectors PDT1–PDT4, PDG1–PDG8, and PDI, status contact(s), CSS, and other sensors (not shown) and status contacts (not shown) are employed in programmed computer operation of the turbine 10 for various purposes including controlling turbine performance on an on-line real time basis.

Figure 2:
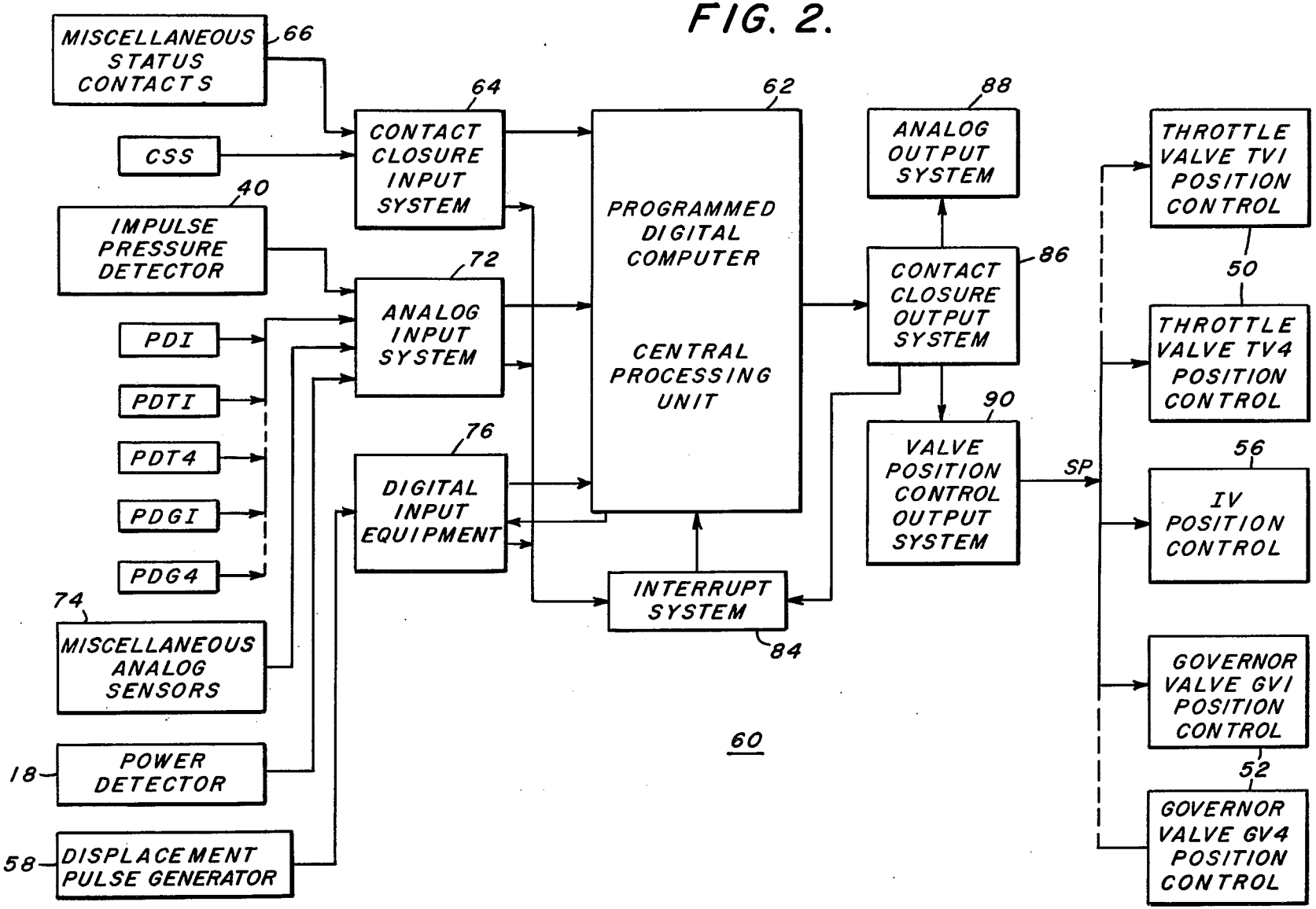
FIG. 2 is a schematic diagram in block diagram form of a programmed digital computer system adapted for controlling the steam turbine system included in FIG. 1 in accordance with the principles of the invention.

As illustrated in FIG. 2, a programmed digital computer control system 60 is provided for operating the turbine 10. The system 60, which is described in the co-pending applications Refs. 1, 2 and 3, above, includes conventional hardware in the form of a central processing unit 42 and associated input/output interfacing equipment such as that sold by Westinghouse Electric Corporation under the tradename PRODAC 2000 (P2000).

The P2000 computer is especially adapted for process control functions. The basis central processing unit consists of four large printed circuit cards including at least one memory card. The P2000 uses a 16-bit word length and memory cards providing 4K, 8K or 16K word memory are available. Up to three additional memory cards may be added to provide up to 64K words of core memory. Sixteen locations in working memory provide fast access memory accessible in less than 500 nano seconds. The ability of the P2000 to operate over a wide range of temperatures and humidity in addition to its tolerance to variations in the voltage and frequency of the power supply contribute to its suitability for use in industrial environments.

The interfacing equipment for the computer processor 62 includes a conventional contact closure input system 64 which scans contacts or other similar signals representing the status of various plant and equipment conditions. Such contacts include the stop valve contact(s) CSS and are otherwise generally indicated by the reference character 66.

Input interfacing is also provided by an analog input system 72 such as that described in reference 5 above which samples analog signals from the plant 12 at the rate of 40 points per second for each analog channel input and converts the signals sampled to digital values for computer entry. The analog signals are generated by the impulse pressure detector 40, the power detector 18, the valve position detectors PDI, PDT1–PDT4 and PDG1–PDG8, and miscellaneous analog sensors 74 such as the throttle pressure detector 38 (not specifically shown in FIG. 2), various steam flow detectors, various temperature detectors, various pressure detectors, etc.

Additional input equipment in the form of the digital input equipment 76 to be described in greater detail below, converts the pulses DP generated by the displacement pulse generator 58 into a digital form suitable for entry into the central processing unit 62.

Output interfacing is provided for the computer by means of a conventional contact closure output system 86 which operates in conjunction with a conventional analog output system 88 and with a valve position control output system 90. The digital output signals supplied to the valve position control output system 90 are converted into analog signals which are applied to the valve controls 50, 52 and 56. The respective signals applied to the valve controls 50, 52 and 56 are the valve position set point signals SP to which reference has previously been made. Output signals from the central processing unit 62 are also applied directly to the digital input equipment 76 in a manner to be described later.

A conventional interrupt system 84 is provided with suitable hardware and circuitry for controlling the input and output transfer of information between the computer processor 62 and the slower input/output equipment. Thus, an interrupt signal is applied to the processor 62 when the input is ready for entry or when an output transfer has been completed. In general, the central processor 62 acts on interrupts in accordance with the conventional executive program. In some cases, particular interrupts are acknowledged and operated upon without executive priority limitations.

DIGITAL INPUT EQUIPMENT

Since the central processing unit 62 of the digital computer must perform a great many calculations in carrying out the control algorithms by which the electric power generating system is controlled, it is not possible to insert the displacement pulses directly into the digital computer central processing unit as they are generated by the displacement pulse generator 58. Preliminary processing of the displacement pulses DP is performed digitally by the digital input equipment 76.

Figure 3:
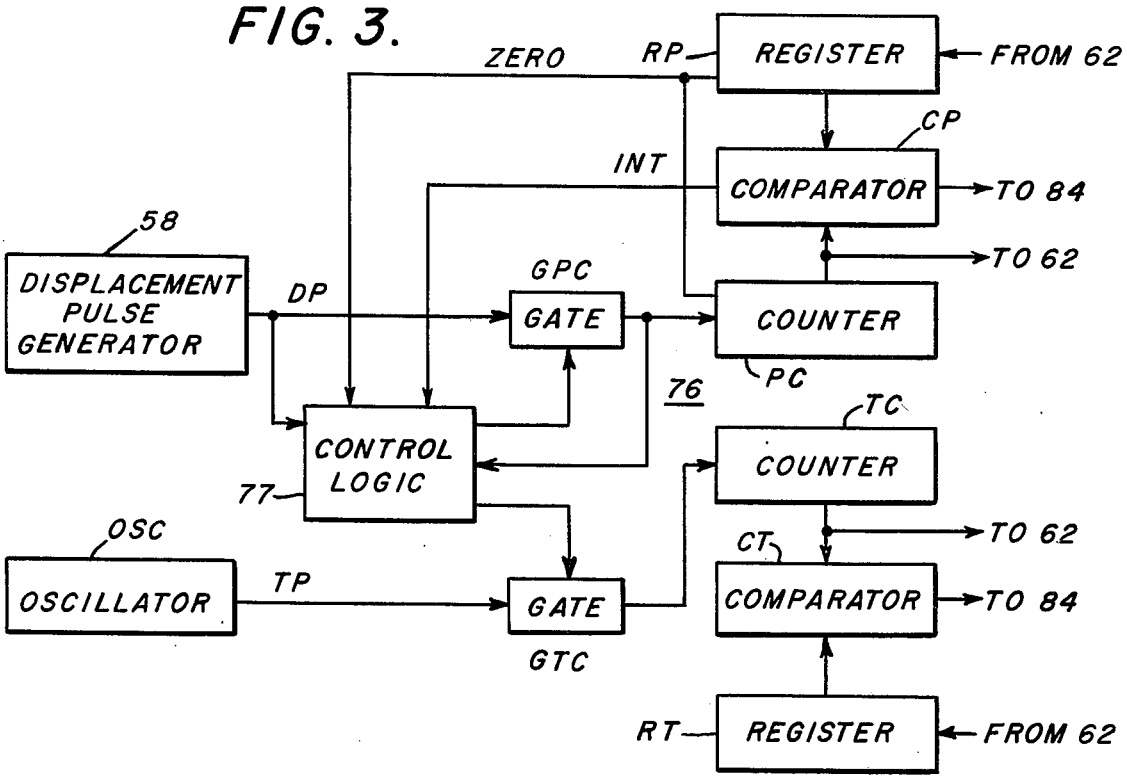
FIG. 3 is a schematic diagram in block diagram form of digital input equipment according to the invention suitable for use with the systems of FIGS. 1 and 2.

FIG. 3 illustrates the components of the digital input equipment 76 in block diagram form. A count of the displacement pulses DP is accumulated in the digital counter PC, the operation of which is supervised by control logic 77 through gate GPC. The count accumulated in the digital counter PC may be read into the central processing unit 62 of the digital computer under conditions to be described below. A signal from the central processing unit 62 delivered through the register RP is used to zero the counter PC under certain conditions.

The count stored in the counter PC is continuously being compared in the comparator CP with a preselected count stored in a register RP. The register RP is set to the preselected count by a signal from the central processing unit 62 of the computer. When the count stored in the counter PC becomes equal to the preselected count stored in the register RP, the comparator CP triggers the interrupt system 84 of the digital computer and at the same time sends a signal INT to the digital input equipment control logic 77. Digital counters, comparators and registers suitable for use in the circuit of FIG. 3 are well known in the electronics art. Hardware is available which combines the functions of the comparator CP and the register RP.

In the preferred embodiment of the invention, measurement of the time interval over which the count of displacement pulses is accumulated, is performed externally of the central processing unit of the digital computer. To this end, timing pulses TP generated by an ocsillator OSC are counted in a second digital counter TC. Again, the accumulation of pulses by the counter is supervised by control logic 77 through gate GTC. The accumulated count of timing pulses in counter TC is compared with a predetermined count stored in register RT in comparator CT. The predetermined count to be stored in register RT is supplied by the central processing unit of the computer. When the accumulated count of timing pulses TPC in counter TC equals the predetermined count set in RT, comparator CT activates the interrupt system 84 of the digital computer. Under conditions to be described below, the accumulated count of timing pulses TPC stored in TC may be real into the central processing unit of the digital computer 62.

Figure 4:
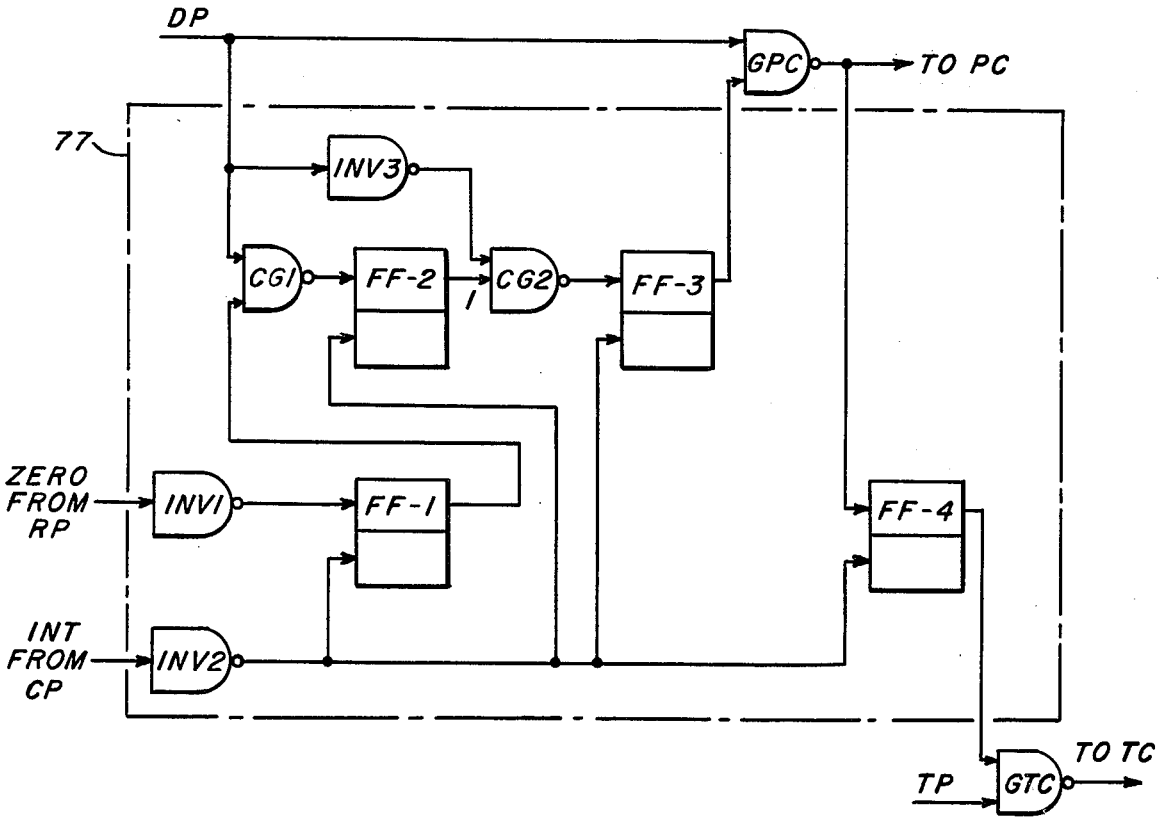
FIG. 4 is a schematic circuit diagram of an exemplary form of control logic suitable for use in the digital input equipment of FIG. 3.

FIG. 4 illustrates in detail the circuitry of the control logic 77 in FIG. 3. The primary purpose of the control logic is to prevent errors in counting by synchronizing the counting by counters TC and PC.

The control logic of FIG. 4 utilizes NAND logic in the form NAND gates, such as CG1 and flip-flops composed of NAND elements, such as FF-1. The circuitry of these components is well known in the electronics art and hence it is sufficient to say at this point that the NAND gate will generate a digital ONE signal at its output unless ONE signals are applied simultaneously to all of its inputs. The flip-flops will generate a digital ONE signal when the upper input goes to ZERO, but the output will switch to ZERO when the lower input goes to ZERO. The flip-flop will maintain either state until the opposite input goes to ZERO. The flip-flop is said to be in the "on" condition when the output is equal to ONE. NAND elements such as INVI having a single input are referred to as inverters since the output signal will always be opposite to the input signal.

When the signal INT goes to ONE indicating that the accumulated count DPC in the displacement pulse counter PC has reached the preselected count, the inverter INV2 will supply a ZERO to the lower input of each of the flip-flops FF-1 through FF-4 thereby turning the flip-flops off. With the flip-flop FF-3 off, a ZERO signal is applied to the lower input of the gate GPC to block the gating of displacement pulses DP to the counter PC. Similarly, with the flip-flop FF-4 off, the timing pulses TP will not be gated to the timing counter TC. Resumption of counting by the counters PC and TC is initiated by the ZERO signal from the central processing unit 62 of the computer. When this signal goes to ONE, the output of the inverter INV1 goes to ZERO to turn flip-flop FF-1 on. With the flip-flop FF-1 on, the generation of the next displacement pulse DP results in the turning on of flip-flop FF-2 through gate GC1. At the end of the displacement pulse DP, the output of inverter INV3 will go to ONE to turn on the flip-flop FF-3 through the gate GC2. Turn on of the flip-flop FF-3 prepares the gate GPC to generate a ZERO signal upon the occurance of the next displacement pulse DP. This not only triggers counter PC, but turns flip-flop FF-4 on which in turn opens GTC to gate timing pulses TP to the counter TC. The counters PC and TC are arranged to count when the output of gate GTC and GPC respectively go to ZERO.

Figure 5:
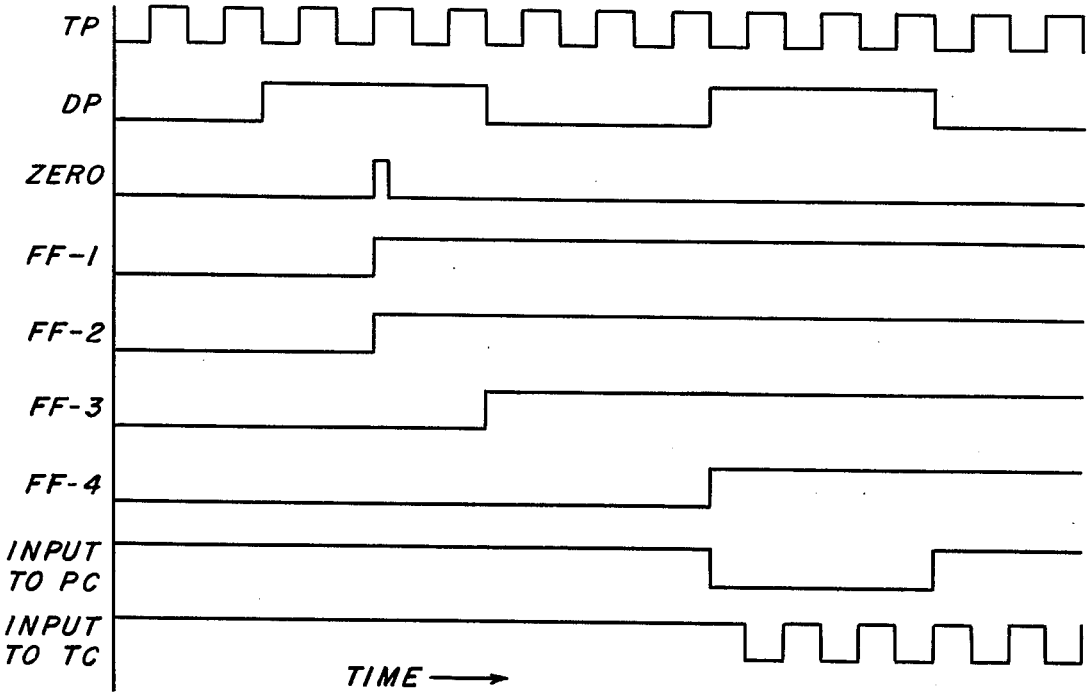
FIGS. 5 and 6 are composite wave forms illustrating the sequence of operation of the components of the circuit of FIG. 4 under two different conditions.
Figure 6:
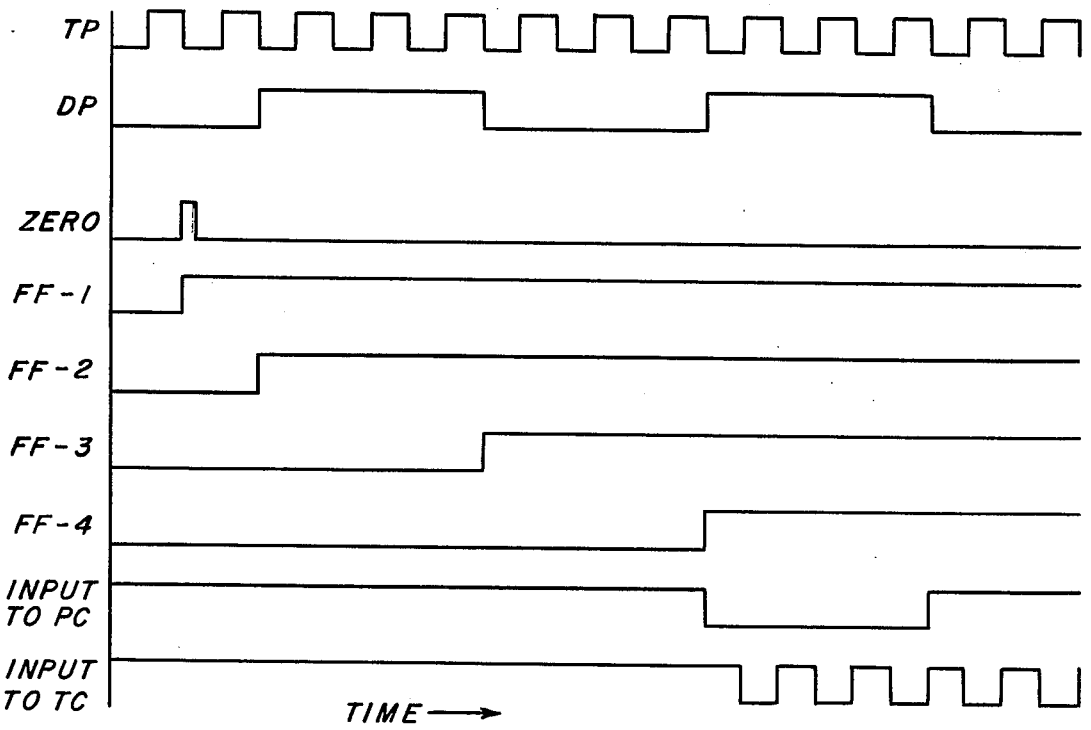

FIGS. 5 and 6 illustrate the operation of logic circuit 77 under two different conditions. Under the conditions shown by FIG. 4, the ZERO pulse generated by the computer occurs during a displacement pulse DP. Under these conditions, the flip-flop FF-2 will be turned on immediately with the flip-flop FF-3 being turned on upon the termination of the displacement pulse DP when the output of INV3 goes to ONE. Upon occurence of the next displacement pulse DP, the output of the gate GPC will go to ZERO thereby turning on gate FF-4 and the counters PC and TC will begin counting their respective pulses.

Under the sequence illustrated in FIG. 6, the ZERO signal from the computer is shown as occuring between displacement pulses DP. Under these conditions, the flip-flop FF-1 will turn on immediately, however, the flip-flop FF-2 will not be turned on until the next displacement pulse DP is generated. From then on the operation of the circuit is identical to that described under the previous conditions with the flip-flop FF-3 being turned on at the end of the displacement pulse and the flip-flop FF-4 being turned on upon initiation of the next displacement pulse DP.

CALCULATION OF THE SPEED SIGNAL

The angular speed of the turbo-generator shaft expressed in revolution per minute (RPM) is determined by dividing the number of revolutions (REV) by the time (T) in which the revolutions were turned. For purposes of calculation, the number of revolutions and the time elapsed can be expressed as follows:

$$REV=DP/DPR \qquad \text{Eq. (1)}$$

wherein

*DP*= the timing pulses counted and

*DPR*= the timing of displacement pulses per revolution $$T=TP/TPM \qquad \text{Eq. (2)}$$

wherein

*TP*= the timing pulses counted and

*TPM*= equals the timing pulses per minute. substituting these terms into the basic equation for determining *RPM:*

$$RPM=DP/DPR \cdot TPM/TP \qquad \text{Eq. (3)}$$

As mentioned previously, the disc 61 connected to the turbo-generator shaft 14 is provided with 60 teeth and the displacement pulse generator 58 generates a pulse as each edge of each tooth passes the reluctance pick-up 59. Therefore, DPR, the number of displacement pulses per revolution, is equal to 120. For reasons to be considered below, the oscillator OSC is selected to have a frequency of 36 kilohertz so that TPM, the number of timing pulses per minute, is equal to $36\times10^3\times60$.

As also mentioned above, the speed of rotation of the turbo-generator shaft may be calculated either as a function of the number of displacement pulses counted in a predetermined time or the amount of time required to accumulate a predetermined count of displacement pulses. If a predetermined interval of 0.1 seconds is selected so that TP becomes equal to 3600, equation (3) may be reduced to the following:

$$RPM=5DP. \qquad \text{Eq. (4)}$$

If approximately the same frequency of sampling is desired in calculating the speed as a function of the time required to accumulate a predetermined count, it can readily be determined that 720 displacement pulses would be generated in 0.1 of a second with the turbo-generator running at a synchronous speed of 3600 RPM. With DP therefore made equal to 720, Equation (3) may be reduced to:

$$RPM=3600^2/TP \qquad \text{Eq. (5)}$$

The specific parameters selected are a matter of choice which is limited only by practical economies. The desired sampling interval is determined as a function of the dynamic response of the system, while the number of displacement pulses per revolution is constrained by economic limitations on the pulse generating hardware. The frequency of the timing pulse oscillator is limited by the response time and the capacity of the digital counters utilized. Since it is possible to economically generate and count timing pulses at a higher frequency than the displacement pulses, speed calculations according to Equation (5) may be made with better resolution than that with Equation (4). However, it should be appreciated that at very low RPM where an excessively long interval would be required to accumulate the number of pulses normally accumulated in 0.1 seconds at synchronous speed, the calculation according to Equation (5) becomes impractical because of the number of digits required to accumulate the count.

OPERATION OF THE DIGITAL INPUT EQUIPMENT

From the above discussion, it can be appreciated that the digital input equipment is operative to generate digital signals which are inputted into the central processing unit of the computer under two conditions. The first condition occurs when the accumulated count of displacement pulses becomes equal to a preselected count as selected by the digital computer. The second condition occurs when the accumulated count of timing pulses reaches a predetermined count which is also established by the digital computer. Upon the occurence of either condition, an interrupt signal is sent to the central processing unit of the computer to prepare it for the transfer of data accumulated in the digital input equipment. Under the first condition, when the timing pulse count becomes equal to the predetermined count, the accumulated count of displacement pulses in the pulse counter PC in inputted into the central processing unit of the digital computer to be used in calculation of the speed of the turbo-generator in accordance with Equation (4) i.e. as a function of the number of displacement pulses generated in a predetermined interval. On the other hand, when the count of displacement pulses in counter PC becomes equal to the preselected count, the accumulated count of timing pulses in the counter TC is inputted into the central processing unit of the digital computer for the purpose of calculating the speed of the turbo-generator according to Equation (5) i.e. as a function of the time required to accumulate a predetermined count of displacement pulses.

As a consequence of the relationship between the pulse repetition rate of the timing pulses and the transfer time necessary to alert and prepare the digital computer for reading the timing pulse count, the accumulation of timing pulses is suspended under the second condition through the operation of the control logic as explained above to avoid errors in the timing pulse count. As also explained above, the accumulation of the count of displacement pulses is also suspended by the control logic under these conditions. Once the timing pulse count TPC has been read into the computer, the counting by the counters PC and TC is resumed as described through the generation of the ZERO signal from the computer which also resets the counter PC to ZERO.

Operation of the digital input equipment can be more easily understood through an example. It will be assumed that the turbo-generator combination is rotating at 3,000 RPM. Under these conditions, 600 displacement pulses rather than 720 will be generated in the sampling time of 0.1 second ($DPC$=720 · (3,000/3,6000)= 600). In addition, 4320 timing pulses will be generated during the interval required to accumulate 720 displacement pulses ($DTC$=3600 · (3600/3000) = 4320).

Figure 7:
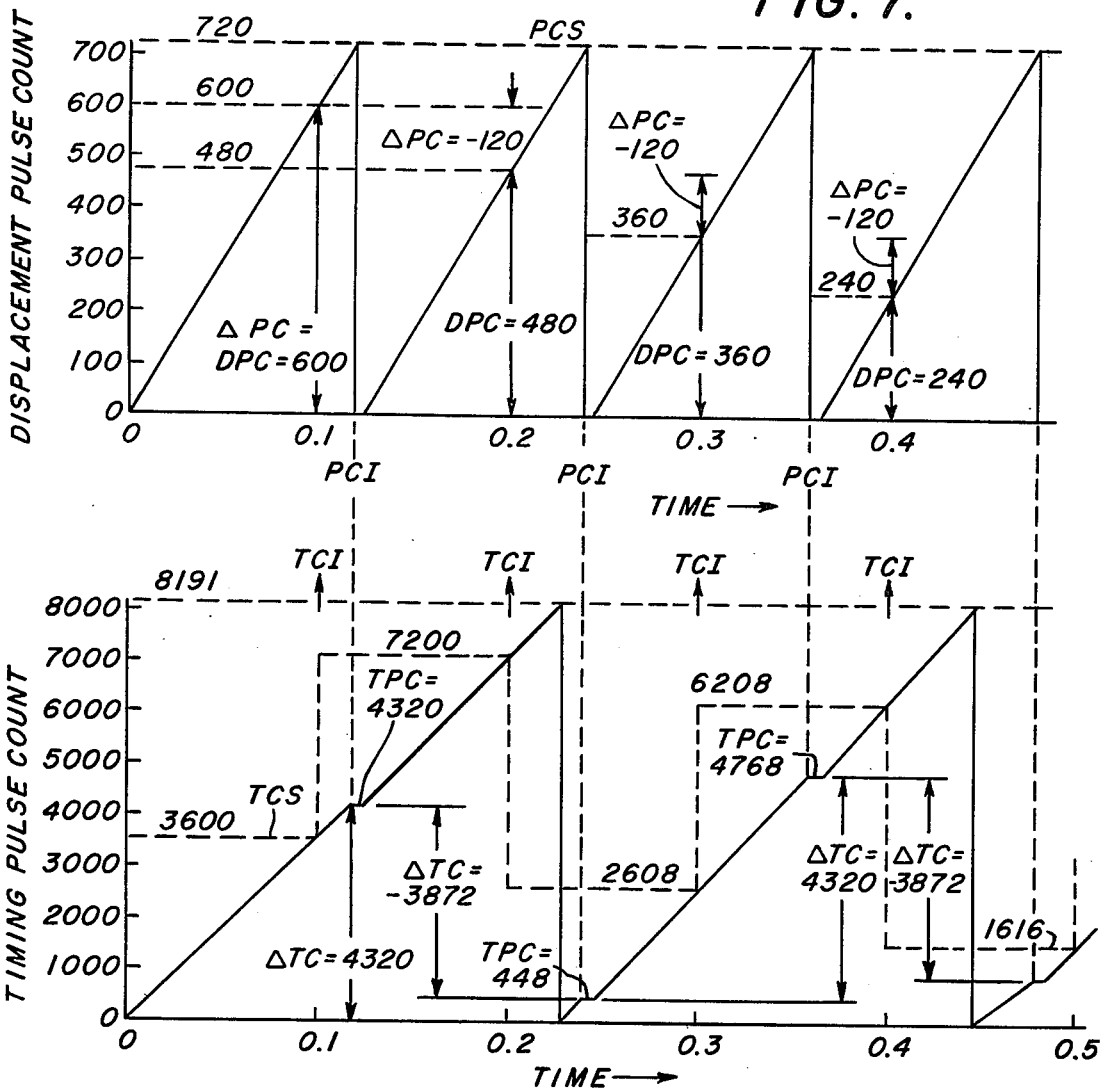
FIG. 7 is a composite wave form illustrating the progressive states of the counters which form part of the digital input equipment shown in FIG. 3.

FIG. 7 is a composite representation of the counts accumulated in counters PC and TC as a function of time. The counters are 13 bit binary counters which are therefore capable of counting from 0 to $2^{13}$ or 8191. The counters are capable of rolling over and counting again from 0 when the accumulated count reaches 8191, however, it will be seen below that the counter PC will be continually reset before it reaches capacity.

For purposes of illustration, it will be assumed that both of the counters PC and TC begin at 0 count at time 0. In view of the assumed sampling time ofj 0.1 seconds, counts of 3600 and 720 will be set in registers RT and RP respectively by the computer. Due to the frequency of the oscillator OSC, the timing pulses will accumulate at a faster rate than the displacement pulses. Further, since it was assumed that the tubo-generator is running below synchronous speed, the timing pulse count TPC will reach 3600 before the displacement pulse count DPC becomes equal to 720. When the timing pulse count becomes equal to 3600, the comparator CT will send an interrupt signal to the computer. The executive program of the computer will evaluate the priority of the interrupt and if a lower priority program is running, it will temporarily discontinue the running program as the next non-jump instruction, store the in process information generated by the program and institute the timing pulse interrupt program details of which will be discussed below. Since the speed interrupts have high priority, they will normally interrupt the running program, if not, the running program will be completed before the speed data will be inputted into the central processing unit of the computer. However, the cycle time for the P2000 computer is extremely high, on the order of 4 micro seconds per per instruction. Therefore, even if a higher priority program is running, the input of the displacement pulse count DPC will be completed within the normal digital error of plus or minus 1 displacement pulse, (at synchronous speed, displacement pulses are generated approximately every 140 micro seconds). For this reason, it is not necessary to suspend counting when reading the displacement pulse counter PC. It will be noted that upon the occurence of the timing pulse interrupt, the accumulated count of displacement pulses DPC in the counter PC is equal to 600. The processing of this data by the central processing unit of the computer will be discussed below.

The timing pulse counter TC is not reset to ZERO at the conclusion of each timing interval. Several timing pulses could be generated during the time required to read the count accumulated in the displacement pulse counter PC. If the timing pulse counter TC was to be reset to ZERO after the transfer of the displacement pulse count, these intermediate timing pulses would be lost so that an incorrect count would be recorded when the displacement pulse interrupt occurs. To preclude the introduction of this error into the speed calculation, the computer accumulatively generates the predetermined count of timing pulses TCS to be inserted into register RT. This calculation is made while the counter TC continues to run and is inserted in RT after only a few timing pulses have been counted so that it is ready for the next timing interrupt. Therefore, in the example under consideration, the computer will add 3600 tpo the previous value, 3600, of TCS and will insert 7200 into RT. The timing pulse counter TC will then continue counting toward 7200.

Before TPC can reach 7200, the displacement pulse count DPC being accumulated in the counter PC will become equal to 720 to generate the PC interrupt which prepares the computer for reading the timing pulse count TPC. The PC interrupt also generates the signal INT which suspends counting by the counters PC and TC, in the manner and for the reason discussed above, while the timing pulse count TPC is read into the central processing unit of the computer. After reading the timing pulse count, the computer ZERO's PC, inserts a preselected count in RP and initiates the resumption of counting through the control logic of FIG. 4. In the interest of computer efficiency, these three functions may be performed by a single signal from the central processing unit 62. The counters and registers in the digital input equipment are provided with 14 bits while the computer uses 16 bit registers. However, only 13 bits in the registers and counters are used for storing or counting. By inserting a ONE in the 14th bit of the computer accumulator before outputting the preselected count to the register RP, the extra bit may be used to ZERO PC and supply the ZERO signal to the control logic circuitry. The extra bit on the counters is utilized to determine if the associated counter is in propogation at the time it is being read, and therefore should be read again.

With the ZERO signal applied to the control logic counting of both the displacement pulses and timing pulses will be reinitiated in synchronism. When TPC reaches 7200, the comparator CT will again send an interrupt signal to the computer and the contents of PC will be read into the central processing unit of the computer. At this point, DPC, the count accumulated in PC, will equal 480. As will be seen below, the computer will calculate the change in the displacement pulse count, ΔDC, to be equal to 480—600 or —120. ΔDC is negative because PC was reset during this timing interval. The central processing unit of the computer will sense that PC was reset by the fact that ΔDC is negative and as a result will add the 720 that was subtracted to arrive at the true ΔDC of 600. The computer will then process $\Delta DC$=600 as before.

In calculating the new TCS to be inserted into RT, the computer will generate $TCS$=7200+3600=10800 which is beyond the capacity of registers RT and TC. However, the counter will roll over when it reaches a count of 8191 and begin counting again from 0. Under these circumstances, 3600 counts after 7200, TC will read 2608 in binary form. Since the computer accumulator has a larger capacity, it can register the 10800 in binary form, however, if only the 13 least significant bits of the computer accumulator are considered, the computer also reads 2608. Since only these digits are outputted by the computer, the binary equivalent of 2608 is inputted to RT. Therefore, the next timing pulse interrupt will occur when the timing pulse count equals 2608.

Before TPC reaches 2608, DPC will again reach 720 to generate the displacement pulse interrupt. From FIG. 7, it will be seen that this will occur under the assumed conditions shortly after the timing pulse counter TC rolls when the timing count is 448. When this is inputted into the computer, the central processing unit will calculate $\Delta TC=448-4230=-3872$. Sensing the roll over from the negative sign of $\Delta TC$, the computer will add 8192 to arrive at the true $\Delta TC$ of 4320.

From the above discussion, the progression of interrupts can be readily followed. Althogh for ease of illustration, it was assumed that the counters TC and PC both started at 0 count, this condition would very rarely occur so that even at synchronous speed when PC interrupts are occuring at intervals equal to the timing intervals, the PC and TC interrupts will not occur simultaneously. In the rare instance where they would simultaneously, the executive program of the computer gives the displacement pulse interrupt higher priority and therefore the timing pulse count will be inputted followed immediately by the displacement pulse count assuming that no higher priority program is bidding.

COMPUTER OPERATION

A steam turbine control programming system is utilized to control the digital computer system 60. It includes control and related programs in addition to conventional house keeping programs such as the executive program mentioned above, which regulates the internal functioning of the computer system itself. The complete programming system which includes routines for controlling the positioning of the various steam valves as a function of selected criteria including actual and desired turbine speed is considered in detail in the co-pending applications Refs. 1, 2 and 3. Therefore, only those portions of the programming system directed to the processing of the data supplied to the computer by the digital input equipment will be discussed herein. This includes the following routines;

1. The pulse count interrupt routine, (Speed Interrupt Program 2),
2. The timing interrupt routine (Speed Interrupt Program 1), and
3. The speed calculation and selection routine.

Figure 10:
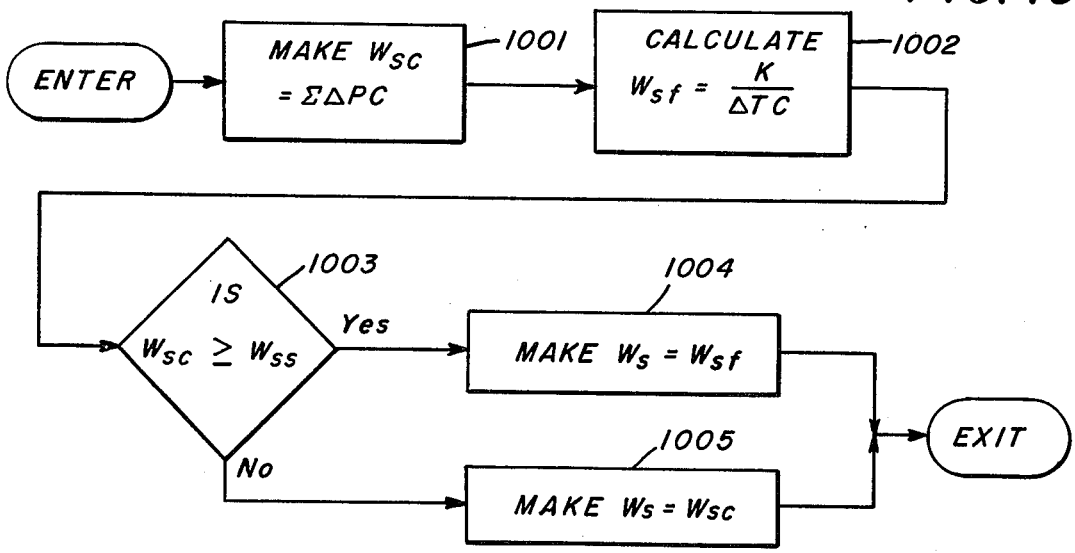
FIGS. 8, 9 and 10 are flow charts for some of the routines employed by the programming system which operates the digital computer system of FIG. 2 according to the principles of the invention.
Figure 8:
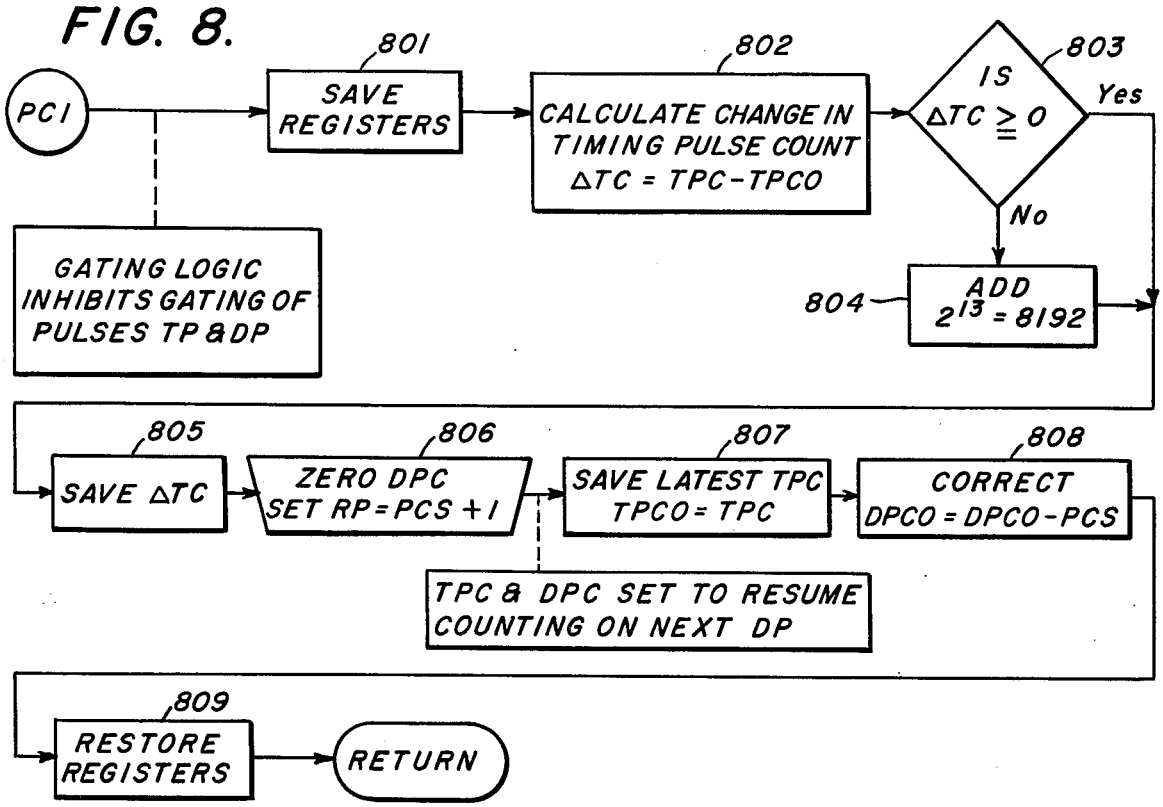
Figure 9:
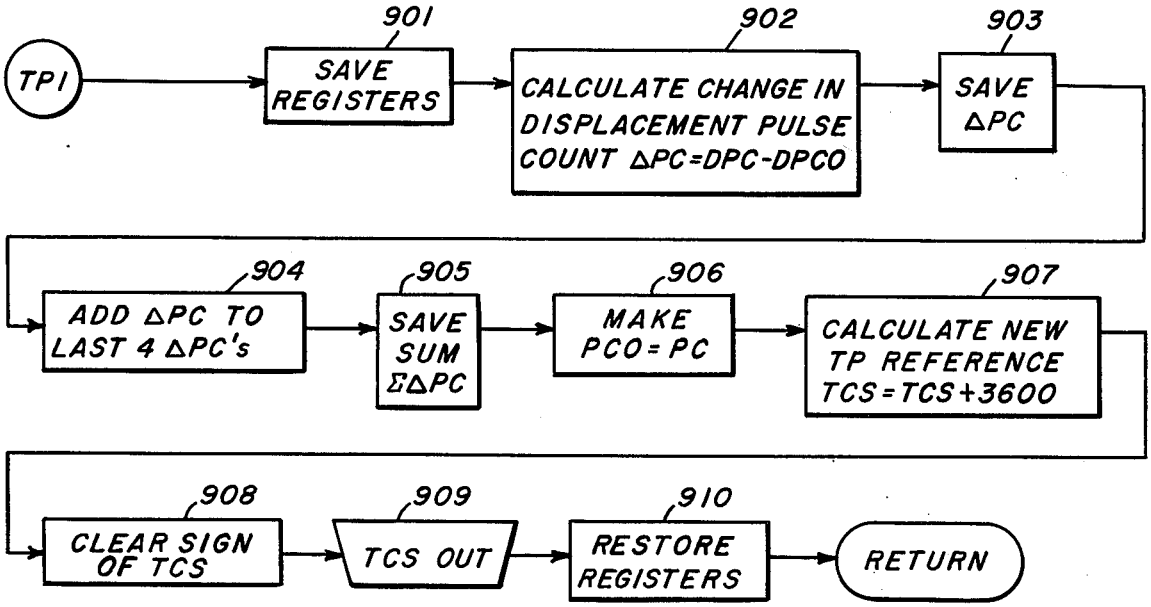

Flow charts for the three routines are shown in FIGS. 8, 9 and 10. Conventional programming techniques may readily be applied to develop program listings from these flow charts. The program may be written in the appropriate machine language or in one of the standard programming languages such as FORTRAN for coversion into the appropriate machine language by a compiler associated with the selected computer. The P2000 compiler or formatter utilizes a set of software routines to transform FORTRAN operations into machine language. Program listings for the routines now to be described, can be found in the appendix of copending application Ref. 3.

The pulse count interrupt routine illustrated in flow chart form in FIG. 8, processes the timing pulse count TPC inputted into the compouter in response to the pulse count interrupt PCI generated by the comparator CT. As shown in FIG. 8, the pulse count interrupt PCI inhibits the gating of the timing pulses and displacement pulses to their respective counters and initiates the pulse count interrupt routine by storing the contents of the working registers in the central processing unit of the computer as indicated by block 801. Since the speed routines have a high enough priority to interrupt a running program, the information generated by the running program up to the time of the interrupt must be stored for later completion of the routine. With the central processing unit registers thus cleared, the change in the timing pulse count $\Delta TC$. which is the difference between the new timing pulse count TPC and the previous timing pulse count TPCO (old timing pulse count) is calculated in block 802. If the timing pulse counter TC has overflowed as indicated by a ngative value of $\Delta$TC (See block 803), $2^{13}$ or 8192 is added to $\Delta$TC in block 804. The true value of $\Delta$TC is stored in 805 for future use by the speed calculating routine to be described subsequently.

In block 806, the computer sends a signal through the digital input equipment which zeros the displacement pulse count, inserts the selected displacement pulse count PSC plus 1 in the register RP and prepares the control logic for the resumption of the accumulation of counts of timing pulses and displacement pulses. The reason for setting the register RP equal to the selected pulse count 720 plus 1 is found in the logic circuit of FIG. 4. Close analysis of the circuited FIG. 4 will reveal that the output of the gate GPC will go to zero at the onset of the first displacement pulse to be counted. Since it will be recalled that the counter TC counts when the input signal goes to ZERO, the accumulated count will go to 1 immediately, and therefore it is necessary to allow PC to accumulate a count of 721 in order to time the interval required to accumulate 720 displacement pulses. This peculiarity is of course a result of the particular design of the circuit of FIG. 4 and may be eliminated through obvious modification of the control logic.

Progressing to block 807, the latest timing pulse count TPC is saved by making the old timing pulse count, TPCO, equal to TPC. Following this, the old displacement pulse count DPCO is corrected for the zeroing of the pulse counter PC by subtracting the selected displacement pulse count PCS from the stored value of DPCO. As a final step, the stored data from the interrupted program is reloaded into the working registers of the central processing unit for completion of the routine in block 809.

The timing interrupt routine illustrated in flow chart form in FIG. 9, processes the displacement pulse count DPC inputted into the computer by the timing pulse interrupt TPI. As in the pulse count interrupt routine, the first step in 901 is to save the data generated by the running program. In step 902, the displacement pulse count DPC in inputted and the change in displacement pulse count $\Delta$PC is calculated. In step 903, $\Delta$PC is saved for future calculations and in step 904, it is added to the last four $\Delta$PC with the sum $\Sigma\Delta$PC being saved in block 905. The reason for summing the the five latest values of $\Delta$PC is to average the value of $\Delta$PC to minimize the effect of the inherent digital error which will be discussed below. Reference to Equation (4) above, shows that with the parameters selected the speed of the turbine shaft in RPM is equal to 5 times the number of displacement pulses accumulated in 0.1 seconds. By summing the last five $\Delta$PC, an average speed signal is generated directly without further calculation.

In block 906, DPCO is updated by making it equal to DPC. The computer then calculates the new value of TPC for the next interval by making TCS equal to the former value of TCS plus 3600. Before outputting TCS to the register RT in block 909, the sign of TCS is cleared in 908 in the event that the newly calculated valve of TCS exceeds 8191. Again the stored data from the interrupted program is reloaded in the registers in block 910 to end the routine.

The flow chart for the speed calculation and selection routine is shown in FIG. 10. It will be recalled from the previous discussion that the speed signal can be calculated with better resolution from Equation (5) rather than Equation (4) due to the higher frequency of the timing pulses when compared with the frequency with which the displacement pulses are generated over the normal operating range of the turbine. In connection with this, the inherent 1 count resolution of digital systems which derives from the fact that a counter may be read just before or just after a pulse is counted, must be considered. Applying this to Equations (4) and (5), it can be seen that Equation (4) provides a speed signal with a resolution of approximately plus or minus 1 RPM at synchronous speed while Equation (5) will provide a speed signal only within plus or minus 5 RPM at synchronous speed. For this reason, the speed signal calculated through Equation (4) (as a function of the time required to accumulate a predetemined count of displacement pulses) is referred to as the fine speed signal (*Wsf*) while the signal calculated through Equation (5) (as a function of the number of displacement pulses accumulated in a predetermined time) is referred to as the coarse speed signal (W*sc*).

It would appear then for the sake of better resolution, that only the fine speed (W*sf*) calculation need be made. However, when it is considered that the speed signal must be derived over the full operating range of the turbine, it can be seen that at the lower speeds, during start-up or shut-down, the fine speed calculation is not practical. As a consequence of the length of the intervals that would be required to accumulate, for instance 720 displacement pulses at the lower RPM, the timing pulse count would be excessive requiring a counter TC with many more digits. As a practical matter, a counter with 13 digits is selected for TC. Substituting the maximum count of 8191 for a 13 bit counter into Equation (5), it is found that the lowest RPM that can be calculated according to Equation (5) is approximately 1580 RPM. Below this speed, the counter TC rolls over before 720 displacement pulses may be counted.

The computer takes these considerations into account by calculating both coarse and fine speed signals and then by testing the coarse speed signal (W*sc*) to see if it is below or above a switch over speed (W*ss*). If the speed of the turbine is below W*ss* as determined by W*sc*, W*sc* is selected as the speed signla. On the other hand, if the coarse speed signal W*sc* is equal to or more than the switch over speed W*ss*, W*sf* is selected as the calculated speed signal. A switch over speed of 1600 RPM was arbitrarily selected to insure that TC would not roll over.

Turning now to FIG. 10, it is seen in block 1001 that the coarse speed W*sc* is available in the form of ΔPC. The fine speed W*sf* is then calculated by dividing ΔTC, the number of timing pulses accumulated between TC interrupts, into a constant K which it will be remembered is equal to $3600^2$. A check on the operating point of the turbine is made in block 1003 by comparing the coarse speed W*sc* with the switch over speed W*ss*. If the value of W*sc* is less than W*ss*, the speed signal W*s* to be used in controlling the turbine system, is made equal to the coarse speed W*sc*. If W*sc* is equal to or more than W*ss*, then W*s* is made equal to the fine speed signal W*sf*.

Reference to the co-pending applications Refs. (1), (2) and (3) will reveal that the digital speed signal developed in the manner just described, and a high grade independently generated analog speed signal which has been converted to a digital signal for input to the computer, are both compared with a supervisory analog signal which has also been converted for processing. The supervisory analog signal, which is not precise enough for control purposes, is used to check the reasonability of the digital speed signal and the high grade analog speed signal. If the digital speed signal is reliable, it is selected for use in the control algroithms of the program system to effect control of the turbine system. The precision analog signal is used as a backup if the digital speed signal proves to be unreliable.

As also described in the co-pending applications, Refs. 1, 2 and 3 the turbine control system assumes three different modes of operation. In the start-up mode, the selected speed signal, which is representative of the actual speed of the turbine, is summed in opposition to a speed reference signal to generate a speed error signal which controls the positioning of the steam valves. The speed reference signal is programmed to accelerate the turbine according to a predetermined pattern. As the turbine approaches synchronous speed, the system is transferred to the synchronizing mode wherein the speed of the turbine is precisely controlled while the turbine is being brought-on-line. As fully discussed in the co-pending applications, the accuracy and response of speed control loop permits synchronization to be achieved without the additional peripheral equipment required by prior art control systems. Once the turbogenerator unit has been brought on-line, the system is transferred to the load control mode of operation. In this mode, a load reference signal is combined in a load control loop incorporating various feedback signals to generate valve position output signals which satisfy the load demand. A speed error signal is developed in this mode of operation as a compensation to the load reference signal to provide for frequency participation of the generating unit in the power network.

The specific embodiment of the invention herein described is meant to be illustrative only. Since it is clear that many of the parameters and components were selected as a result of practical compromises, it should be understood that many modifications fully within the scope and spirit of the invention could be made. As an example, the timing functions could be performed within the central processing unit of the digital computer rather than by the oscillator or the digital input equipment. However, since the computer uses line frequency for its internal timing functions, it would be necessary to provide a separately regulated power supply for the computer independent of the power generated by the turbo-generator combination being controlled to avoid errors in timing caused by changes in the rotational speed of the turbo-generator combination which of course is the variable being measured.

Part of the listing in the present invention is included infra, herein, as appendix I:

```
JOB XX003,05 PASEMANN                    DEH-SPEED-CH  SPINT2
P2KASM
        BIN
*
*          INTERRUPT PROGRAM FOR PICK UP RK CARD INT
*
BETA     COM      54
DCNT2    EQU      BETA+22
BLDC1    EQU      BETA+23
SPINT2   IOA      X'A2'                INPUT FROM BSC-CC CH42
         STA      NEWC2                SAVE INPUT
         AND      =X'2000'             WAS COUNTR IN PROPAGATION
         ZJP      $+2                NO
         JMP      $-4                  YES REPEAT INPUT
         LDA      NEWC2
         SUB      BLDC2
         ZJP      $+2
         ADD      =X'2000'             ADD 2POWER13 IF BSC-CC ROLLED OVER
         STA      DCNT2                STORE CHANGE IN COUNT
         LDA      SPREF2
         IOA      X'20'                RESET PICK UP CC AND RK CARD.
         LDA      NEWC2                SAVE INPUT
         STA      BLDC2
         LDA      BLDC1                CORRECT BLDC1
         SUB      SPREF
         STA      BLDC1
         JMP      *223
SPREF    DAT      720
SPREF2   DAT      721+X'2000'
NEWC2    DAT      0
BLDC2    DAT      0
         END      SPINT2
```

```
JOB XX003,05 PASEMANN                    DEH-SPEED-CH  SPINT1
P2KASM
        BIN
*
*          INTERRUPT PROGRAM FOR BSZ, RK CARD INT
*
BETA     COM      54
!SPCOUNT EQU      BETA+10
DCNT1    EQU      BETA+21
BLDC1    EQU      BETA+23
SPINT1   IOA      X'A1'                INPUT FROM PICK UP CC,CH 41
         STA      NEWC1                SAVE INPUT
         AND      =X'2000'             WAS COUNTR IN PROPAGATION
         ZJP      $+2                NO
         JMP      $-4                  YES REPEAT INPUT
*
         LDA      REBU+3
         STA      REBU+4
         LDA      REBU+2
         STA      REBU+3
         LDA      REBU+1
         STA      REBU+2
         LDA      REBU
         STA      REBU+1
*
         LDA      NEWC1
         SUB      BLDC1
         STA      REBU
*
         ADD      REBU-1
         ADD      REBU+2
         ADD      REBU+3
         ADD      REBU+4
         STA      DCNT1
*
         LDA      NEWC1                SAVE INPUT
         STA      BLDC1
         LDA      BLDR2
         ADD      =3600
         AND      =X'1FFF'             CLEAR FIRST 3 BITS TO HANDLE OVERFL
```

```
        STA     GLDR2
        IOA     X'23'          OUTPUT TO  OSC RK CH 43
        INC     ISPCOUNT
        JMP     *223
NEWC1   DAT     0
GLDR2   DAT     0
DCNTN   DAT     0
DCNTO   DAT     0
REPU    RES     5
        END     SPINT1
```

```
      WSTATCON=.TRUE.
      GWCONT=.TRUE.
      IF(SINGLV) GO TO 48
      SINGLV=.TRUE.
      MODCH=.TRUE.
      RANGBIG=.TRUE.
43    CONTINUE
C
C                 CHECK MANUAL NOT TRACKING
C
      TEMP=ITVAO-ITVMAN
      IF(ABS(TEMP) .GE. TVMANDB) GO TO 49
      TEMP=ISVAO-IGVMAN
      IF(ABS(TEMP) .LT. GVMANDB) GO TO 50
49    MANOTRAK=.TRUE.
C
C*****************************************************************************
C
C                 SELECT SPEED PROGRAM
C
C*****************************************************************************
C
50    IF(ISPCOUNT .GE. N5) GO TO 5001
S     LDA         =3913
S     IOA         32
5001  ISPCOUNT=0
      WSCOURSE=ICOURSE
      TEMP=IFINE
      WSFINE=WR*WR/TEMP
      IF(WSCOURSE .GE. WSWITCH) GO TO 51
      WSDIG=WSCOURSE
      GO TO 52
51    WSDIG=WSFINE
52    SPTP=.FALSE.
      ANAGPDF=.FALSE.
      DIGGPDF=.FALSE.
      TEMP=WSDIG
      IF(ABS(WSDIG-GPCSPEED) .LT. WSERROR) GO TO 54
      IF(ABS(GPCSPEED-WSHPSI) .LT. WSERROR) GO TO 53
      IF(ABS(WSDIG-WSHPSI) .GE. WSERROR) GO TO 57
      ANAGPDF=.TRUE.
```

What is claimed is:

1. A system for operating a turbine in which an elastic fluid imparts rotation to the turbine, comprising valve means for controlling the flow of elastic fluid to the turbine, means for controlling the valve means in accordance with a desired turbine speed, means for generating a first series of pulses at a rate proportional to the rotational speed of the turbine, means for generating a second series of pulses at a predetermined rate, which rate is substantially greater than the generated rate of the first series at the upper range of turbine speed, means to count the number of pulses of the first series during a predetermined time interval, means to count the number of pulses of the second series during the generation of a predetermined number of pulses of the first series, means to generate a first signal corresponding to the counted number of the first series of pulses, means to generate a second signal corresponding to the counted number of the second series of pulses, means governed by a predetermined rotational speed of the shaft and the count of the first and second series of pulses to select one of the first and second signals, and means to operate the valve control means in accordance with the selected one of the first and second signals.

2. A system according to claim 1 wherein the selection means operates to select the first signal at times when the speed is below a predetermined speed, and operates to select the second signal at times when the speed is above a predetermined speed.

3. A system for controlling the operation of a power plant in accordance with selected criteria including rotational speed, comprising a turbine in which an elastic fluid imparts rotation to an output shaft;

valve means for controlling the flow of elastic fluid to the turbine;

means for generating displacement pulses as a function of incremental shaft rotation;

means for accumulating a direct digital count of the displacement pulses;

means for measuring the time interval required to accumulate a preselected count of the displacement pulses;

calculating means including means governed by the accumulating means and the measuring means to calculate periodically a representation of shaft speed as a function of the time interval required to accumulate the preselected count; and means including the calculated speed representation to control the operation of the valve means.

4. The system of claim 3 wherein at least the calculating means is structured in a programmed digital computer.

5. The control system of claim 3 wherein the calculating means includes means to select the preselected count of displacement pulses.

6. A system for controlling the operation of a power plant in accordance with selected criteria including rotational speed, comprising a turbine in which an elastic fluid imparts rotation to an output shaft;

valve means for controlling the flow of elastic fluid to the turbine;

means for generating displacement pulses as a function of incremental shaft rotation;

first counting means for accumulating a direct digital count of the displacement pulses;

an oscillator for generating timing pulses;

second counting means for accumulating a count of timing pulses;

calculating means governed by one of the counting means at times when the other of the counting means reaches a predetermined count to periodically calculate a representation of the speed of rotation of the output shaft as a function of the accumulated direct digital count of the displacement pulses and the time period in which said count was accumulated; and means including means governed by the calculated speed representation to control the operation of the valve means.

7. The system of claim 6 wherein at least the calculating means is structured in a programmed digital computer.

8. The system of claim 6 wherein the calculating means includes means to generated interrupt signals at predetermined time intervals, and means governed by the interrupt signals to calculate the speed or rotation of the output shaft as a function of the count of the displacement pulses accumulated in the predetermined time interval.

9. The control system of 8 wherein the calculating means includes means to determine the predetermined intervals of time.

10. The control system of claim 8 wherein the calculating means includes means to calculate the speed of rotation as a function of the counts of displacement pulses accumulated over more than one of the most recent predetermined time intervals.

11. The control system of claim 6 wherein the means provided for determining when the accumulated count of timing pulses in the second counting means reaches said predetermined count includes register means for storing the predetermined count, comparator means for comparing the accumulated count of timing pulses in the second counting means with the predetermined count stored in the register, and means for initiating the accumulated count of displacement pulses when the accumulated count of timing pulses equals said predetermined count.

12. The control system of claim 11 wherein the calculating means includes means to calculate the predetermined count, and for inserting said predetermined count in the register.

13. The control system of claim 12 wherein the calculating means includes means to accumulatively calculate the predetermined count for each new interval.

14. The control system of claim 13 wherein the means provided for determining when the accumulated count of displacement pulses equals the preselected count includes second register means for storing the preselected count, comparator means for comparing the accumulated count of displacement pulses in the first counting means with the preselected count stored in the second register and wherein means are provided for controlling the calculating means by the accumulated count of timing pulses when the accumulated count of displacement pulses equals the preselected count.

15. The control system of claim 6 including means for controlling the calculating means by the accumulated count of timing pulses in the second counting means at times when the accumulated count of displacement pulses in the first counting means reaches a preselected count.

16. The control system of claim 15 wherein the frequency of the timing pulses generated by the oscillator is several times the frequency of the displacement pulses generated in the normal operating range of the turbine, said combination including inhibiting means responsive to the equality of the accumulated count of displacement pulses and the preselected count of displacement pulses for inhibiting the counting of timing pulses by the second counting means.

17. The control system of claim 16 wherein the inhibiting means also inhibits the counting of displacement pulses by the first counter when the accumulated count of displacement pulses becomes equal to said preselected count.

18. The control system of claim 17 wherein the calculating means includes means to render the inhibiting means ineffective to inhibit the counting of displacement pulses and timing pulses by the first and second counting means respectively, and including means for synchronizing the resumption of counting by the two counting means.

19. The control system of claim 6 including means for governing the calculating means by the accumulated count of displacement pulses in the first counting means at times when the accumulated count of timing pulses in the second counting means reaches a predetermined count, means for governing the calculating means by the accumulated count of timing pulses in the second counting means at times when the accumulated count of displacement pulses in the first counting means reaches a preselected count, and said calculating means includes means to calculate the speed or rotation of the output shaft of the turbine as a function of either of the accumulated counts.

20. A method of controlling a turbine in which an elastic fluid metered through valve means is employed to impart rotation to a output shaft, said method comprising generating displacement pulses as a function of the incremental rotation of the shaft, digitally accumulating a count of said displacement pulses, generating timing pulses, accumulating a count of the timing pulses, comparing the accumulated count of timing pulses with a predetermined count of timing pulses, generating a speed signal in accordance with one of the accumulated counts at times when the other of the accumulated counts reaches a predetermined count, generating control signals to position the valve means in accordance with selected criteria including the speed signal, and positioning the valve means to the position called for by the control signals.

21. The method of claim 20 comprising digitally measuring the time interval required to accumulate a preselected count, and generating the speed signal as a function of the interval required to accumulate the preselected count.

22. The method of claim 21 wherein the method of digitally measuring the time interval required to accumulate a preselected count of displacement pulses comprises the method steps of accumulating a count of timing pulses, comparing the accumulated count of displacement pulses with said preselected count, and generating the speed signal in accordance with the accumulated count of displacement pulses when such count equals the preselected count.

23. The method of claim 22 wherein the frequency of the timing pulses is substantially greater than the frequency at which the displacement pulses are generated for the normal operating range of the turbine, and including the method steps of terminating the accumulation of the count of timing pulses upon the accumulation of the preselected count, and initiating the resumption of the accumulation of the count of timing pulses subsequent to the accumulation of the preselected count.

24.The method of claim 23 including the step of synchronizing the resumption of the accumulation of the count of timing pulses with the occurrence of the displacement pulses.

25. The method of claim 21 generating a signal representative of the speed of rotation of the output shaft as a function of the number of displacement pulses counted during a predetermined interval, and selecting one of said signals as the speed signal utilized in generating the control signals for positioning the valves.

26. A method of determining the rotational speed of a shaft over an extended range of speeds, comprising:

generating a first series of pulses at a rate proportional to the rotational speed of the shaft;

generating a second series of pulses at a predetermined rate, which rate is substantially greater than the generated rate of the first series at the upper range of operating speed of the shaft;

counting the number of the first series of pulses generated during a predetermined time interval;

counting the number of the second series of pulses generated during the generation of a predetermined number of the first series of pulses, generating a first speed signal in response to the number of counted first series of pulses, generating a second speed signal is generated in response to the number of counted second series of pulses, and controlling the rotational speed of the shaft in a selected one of the first and second speed signals.

27. A method according to claim 26 wherein the rotational speed is controlled in accordance with the first speed signal when the speed of the shaft is below a predetermined speed, and the rotational speed is determined in accordance with the second speed signal when the speed of the shaft is above a predetermined speed.

* * * * *